US008272918B2

(12) United States Patent
Lam

(10) Patent No.: US 8,272,918 B2
(45) Date of Patent: Sep. 25, 2012

(54) SIMULATION DOG TAIL SWINGING INSTALLMENT

(76) Inventor: Tsui King Lam, Kowloon (HK)

( * ) Notice: Subject to any disclaimer, the term of this patent is extended or adjusted under 35 U.S.C. 154(b) by 324 days.

(21) Appl. No.: 12/633,802

(22) Filed: Dec. 9, 2009

(65) Prior Publication Data

US 2011/0003528 A1 Jan. 6, 2011

(30) Foreign Application Priority Data

Jul. 3, 2009 (CN) ..... 2009 1 0144027

(51) Int. Cl.
*A63H 3/20* (2006.01)

(52) U.S. Cl. ..... 446/330

(58) Field of Classification Search ..... 446/30
See application file for complete search history.

(56) References Cited

U.S. PATENT DOCUMENTS 2,098,166 A * 11/1937 Rubenstein ..... 446/337
7,517,271 B1 * 4/2009 Alfaro ..... 446/359

* cited by examiner

*Primary Examiner* — Michael D Dennis

(57) ABSTRACT

A simulation tail swinging installment includes a base plate, an electromagnetic coil disposed on the base plate, a battery module configured for supplying power to the electromagnetic coil, and a control circuit coupled to the battery module. The simulation tail swinging installment further includes a furcated component having two arms disposed with respect to the electromagnetic coil, with the two arms located on opposite sides of the electromagnetic coil, respectively. Each of the arms includes a permanent magnet positioned in correspondence with the electromagnetic coil. The furcated component is mounted to the base plate through a pivot connected to the base plate. A first driving cable and a second driving cable are attached to the two arms, respectively. The first driving cable and the second driving cable extend through and along two side portions of a simulation tail and secured to a distal end of the simulation tail.

19 Claims, 5 Drawing Sheets

Replacement Sheet

Replacement Sheet

SIMULATION DOG TAIL SWINGING INSTALLMENT

BACKGROUND OF THE INVENTION

The present invention relates generally to toys, and more particularly, to a tail swinging installment for use in an animal toy.

Various toys that simulate the shape of animals are currently being developed. With continuous advancing of the manufacturing process and in order to meet the consumer's needs, this type of toys look increasingly life-like, which brings people joy. Some live animals such as dogs swing their tails to send a message of friendliness when approaching their masters. Some of current animal toys also have a similar simulation tail swinging installment. However, the swinging installment of the existing animal toys can not vividly swing the tail when simulating the tail swing. In addition, the manufacturing cost of the existing swinging installment is high. Moreover, the existing swinging installment consumes is too energy-consuming which results in a short life of batteries for powering the swinging installment.

What is needed, therefore, is a simulation tail swinging installment which eliminates or mitigate at least one of the foregoing drawbacks.

BRIEF SUMMARY OF THE INVENTION

Accordingly, the present invention is directed to a toy tail swinging installment which can be manufacture with lower cost.

The present invention is also directed to a toy tail swinging installment which produces lower noises during use.

The present invention is further directed to a toy tail swinging installment which is more energy-saving.

In one aspect, the present invention provides a simulation tail swinging installment including a base plate, an electromagnetic coil disposed on the base plate, a battery module configured for supplying power to the electromagnetic coil, and a control circuit coupled to the battery module. The simulation tail swinging installment further includes a furcated component having two arms disposed with respect to the electromagnetic coil, with the two arms located on opposite sides of the electromagnetic coil, respectively. Each of the arms includes a permanent magnet positioned in correspondence with the electromagnetic coil. The furcated component is mounted to the base plate through a pivot connected to the base plate. A first driving cable and a second driving cable are attached to the two arms, respectively. The first driving cable and the second driving cable extend through and along two side portions of a simulation tail and secured to a distal end of the simulation tail.

In one embodiment, the simulation tail swinging installment further includes a pulley disposed along a path of the first driving cable for guiding the first driving cable.

In one embodiment, the simulation tail includes a plurality of articulated members, each of the articulated members forming cable holes for allowing the first and second driving cables to extend therethrough.

In one embodiment, the battery module is a solar battery module.

In one embodiment, the control circuit is one of a battery positive-negative polarity inverting switch and a battery positive-negative polarity inverting circuit.

In another aspect, the present invention provides a simulation tail swinging installment for swinging a simulation tail comprising a plurality of articulated members. The swinging installment includes a battery module, electromagnetic coils disposed at opposite sides of the articulated members, and an iron members disposed at joints of the articulated members. The simulation tail swinging installment further includes a control circuit configured to control the battery module to selectively supply power to electromagnetic coils at only one of the opposite sides of the articulated members at a time thus causing a swinging activity of the simulation tail.

In yet another embodiment, the present invention provides a simulation tail swinging installment including a magnetically interactable module and an electromagnetic module disposed with respect to the magnetically interactable module. At least one of the magnetically interactable module and the electromagnetic module is connected with a simulation tail for driving the simulation tail to swing when the magnetically interactable module magnetically interacts with the electromagnetic module. The simulation tail swinging installment further includes a battery module configured to supply power to the electromagnetic module to cause interaction between the magnetically interactable module and the electromagnetic module. The battery module is configured to selectively supply power to the electromagnetic module in a first mode in which the interaction between the magnetically interactable module and the electromagnetic module causes the simulation tail to swing in a first direction, and a second power mode in which the interaction between the magnetically interactable module and the electromagnetic module causes the simulation tail to swing in a second opposite direction.

In one embodiment, the magnetically interactable module includes a first permanent magnet and a second permanent magnet. The first permanent magnet is configured to drive the simulation tail through a first driving cable, and the second permanent magnet is configured to drive the simulation through a second driving cable.

In one embodiment, the first and second permanent magnets are disposed on two movable arms, and the pivotable arms are disposed on opposite sides of the electromagnetic module and movable with respect to the electromagnetic module.

In one embodiment, the first driving cable extends through and along one side portion of the simulation tail and is secured to a distal end of the simulation tail, and the second driving cable extends through and along an opposite side portion of the simulation tail and is secured to the distal end of the simulation tail.

In one embodiment, each of the articulated members has cable holes for allowing the first and second driving cables to pass therethrough.

In one embodiment, the electromagnetic module comprises an electromagnetic coil configured to repulse one of the first and second permanent magnets while attracting the other of the first and second permanent magnets when the electromagnetic coil is energized.

In one embodiment, the simulation tail includes a plurality of articulated members, the magnetically interactable module comprises a plurality of magnetic conductive members disposed at joints of the articulated members, and the electromagnetic module comprises a plurality of electromagnetic coils disposed on opposite sides of the articulated members.

In one embodiment, the magnetic conductive members and the electromagnetic coils are arranged alternately along the simulation tail.

In one embodiment, only the electromagnetic coils at one side of the simulation tail are energized in the first power mode, and only the electromagnetic coils at the other side of the simulation tail are energized in the second power mode.

In one embodiment, each articulated member with the electromagnetic coil disposed thereon has a hole defined therethrough, and the battery module comprises a wire extending through the hole to supply the power to the corresponding electromagnetic coil.

In one embodiment, the simulation tail swinging installment further includes a control circuit coupled to the battery module for controlling the first and second power modes.

In various embodiments of the present invention, the control circuit may be one of a battery positive-negative polarity inverting switch and a battery positive-negative polarity inverting circuit. When the switch of the control circuit is slid to that one set of polarities of the battery module such that the magnetic pole of the electromagnetic coil is the same as the magnetic pole of the permanent magnet on the furcated component, the permanent magnet on the furcated component and the electromagnetic coil repulse each other based on the principle that same poles repulse. The furcated component thus drives the first driving cable to move in a clockwise direction such that the first driving cable drives the simulation dog tail to swing leftward. When the switch of the control circuit is slid to the other set of polarities of the battery module such that the magnetic pole of the electromagnetic coil is opposite to the magnetic pole of the permanent magnet on the furcated component, the permanent magnet on the furcated component and the electromagnetic coil attract each other based on the principle that opposite poles attract. The furcated component thus drives the second driving cable to move in a counterclockwise direction such that the second driving cable drives the simulation tail to swing rightward.

The pulley may be used to guide the first driving cable as well as reduce friction between the first driving cable and various parts of the swinging installment thus protecting the driving cable.

The cable holes formed in the articulated members of the simulation tail can also guide and protect the driving cables.

In view of the foregoing, the present simulation tail swinging installment operates based on the electromagnetic driving principle, such that the simulation animal tail can be driven to swing vividly by consuming lower energy. Therefore, the present simulation tail swinging installment can have al lower manufacturing cost, produce less noise as well as consume less energy thus prolonging the use time of the battery module.

In order to make the aforementioned and other features and advantages of the present invention more comprehensible, embodiments accompanied with figures are described in detail below.

DETAILED DESCRIPTION OF THE INVENTION

Figure 1:
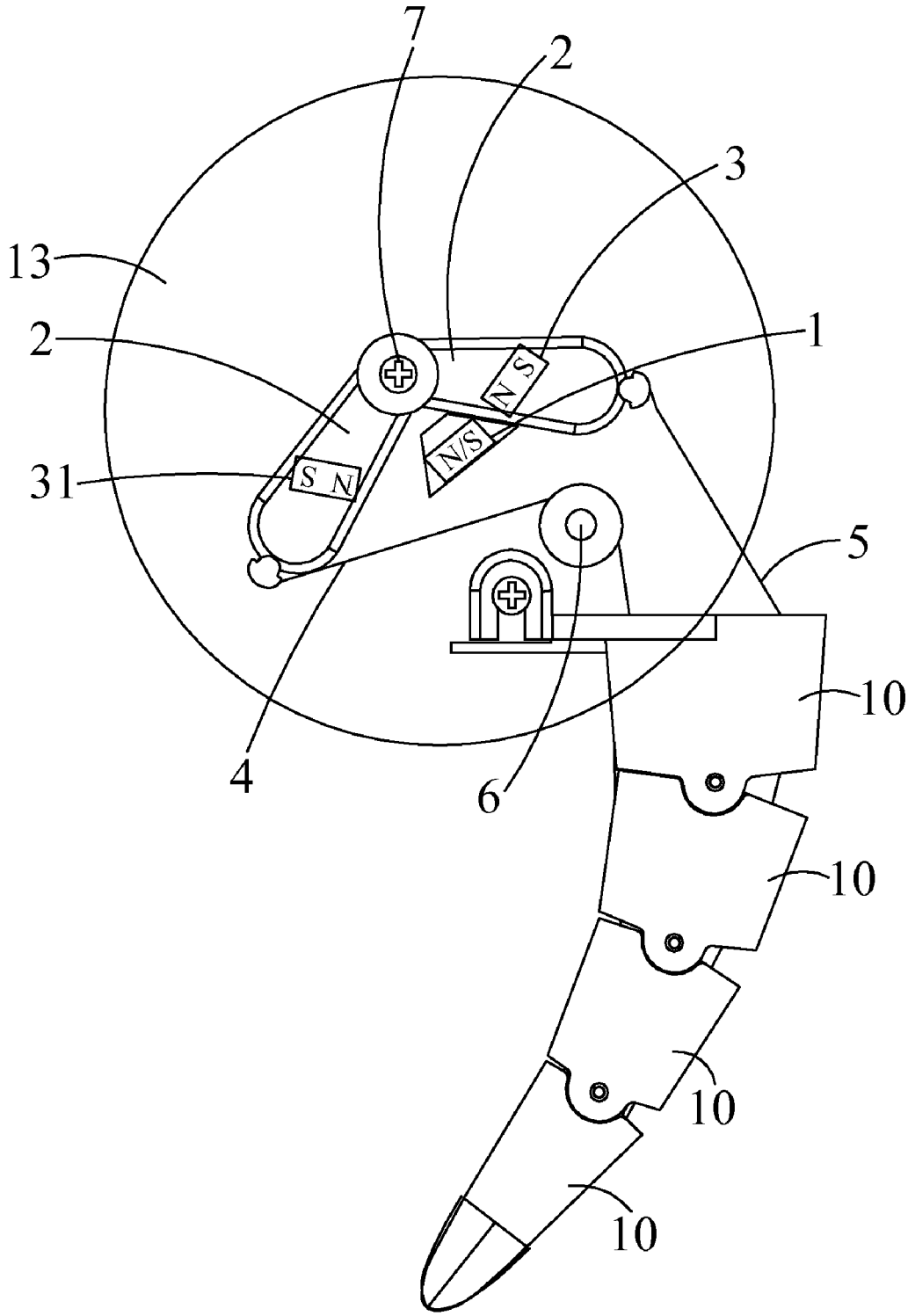
FIG. 1 illustrates a first embodiment of the present simulation tail swinging installment.

Before at least one independent embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

The use of "including", "having", and "comprising" and variations thereof herein is meant to encompass the items listed thereafter and equivalents thereof as well as additional items. The used of "connecting", "coupling", "mounting" or variations thereof herein is meant to include both direct and indirect connecting, coupling or mounting. The use of "consisting of" and variations thereof herein is meant to encompass only the items listed thereafter. The use of letters to identify elements of a method or process is simply for identification and is not meant to indicate that the elements should be performed in a particular order.

First Embodiment

Figure 2:
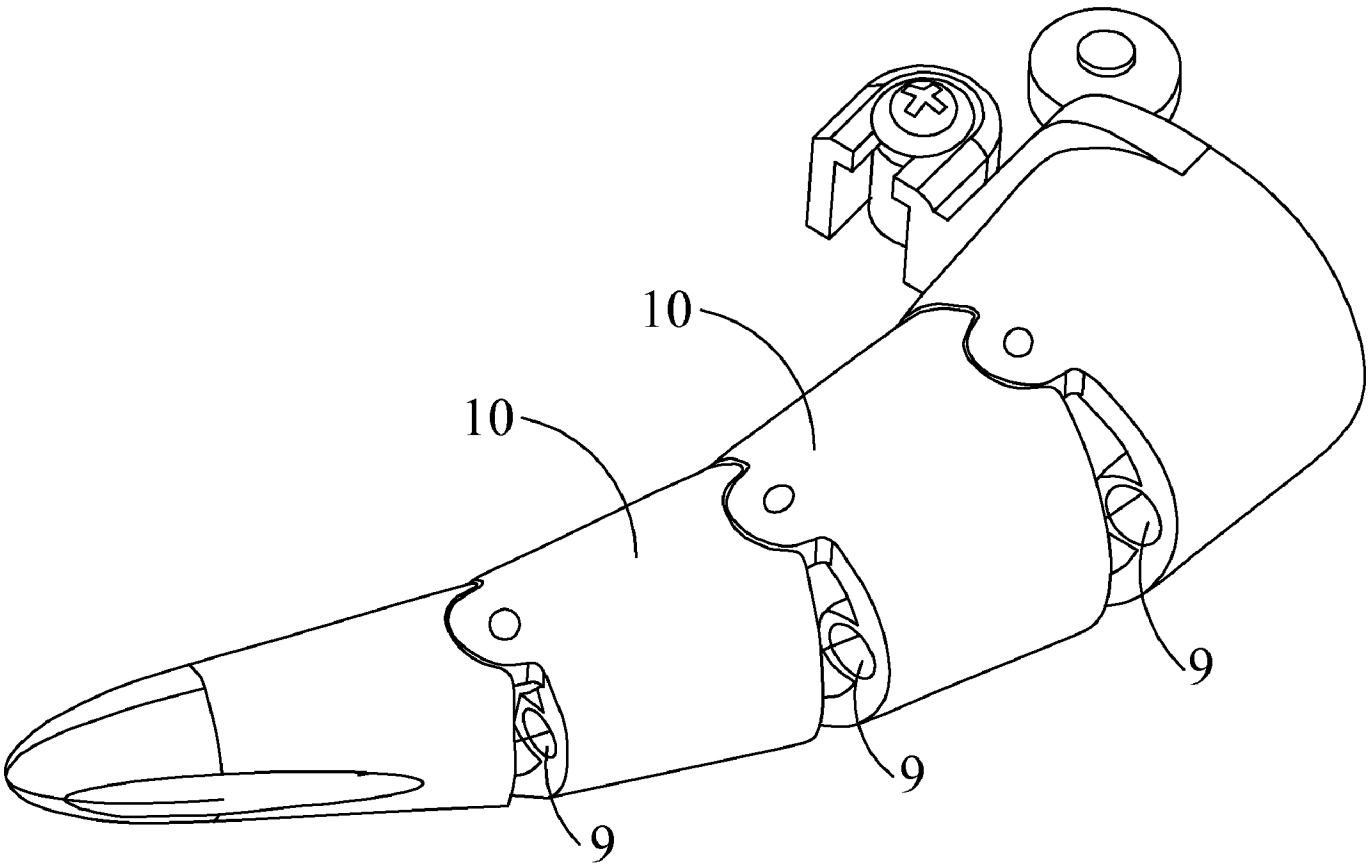
FIG. 2 illustrates a simulation tail and cable holes thereof according to the first embodiment.
Figure 5:
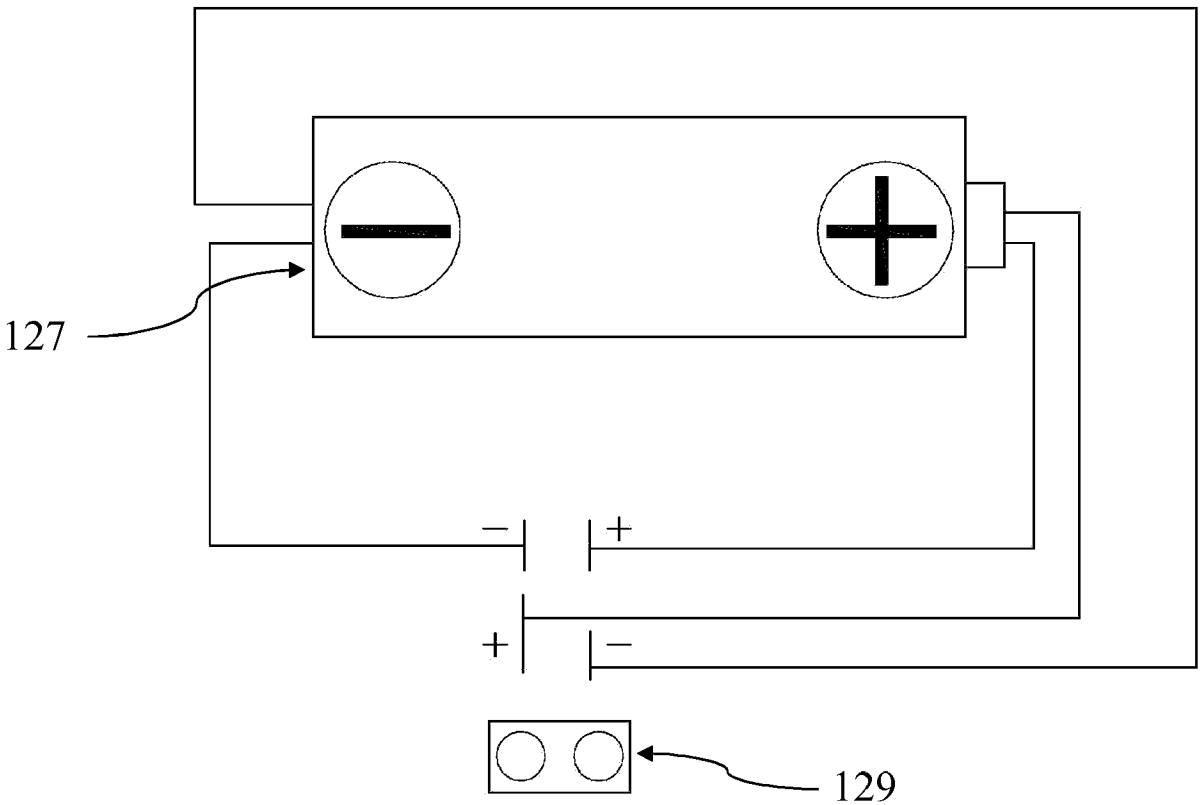
FIG. 5 is a simplified diagram showing a positive-negative polarity inverting switch according to one embodiment of the simulation tail swinging installment.

Referring to FIGS. 1, 2 and 5, a simulation tail swinging installment or apparatus in accordance with a first embodiment is illustrated for swinging a simulation dog tail 10. As shown, the simulation dog tail 10 includes a plurality of articulated members which provide the free swinging activity of the simulation tail through relative movements between the articulated members. The simulation dog tail 10 is illustrated as having four articulated members. It should be understood, however, that the number of the articulated members of the simulation dog tail 10 can be varied based on actual requirements or designs. While the simulation tail swinging installment is described herein in conjunction with the simulation dog tail 10, it is noted that the simulation tail swinging installment described herein can also be used with another animal's tail such as a cat tail.

The simulation tail swinging installment includes a base plate 13, an electromagnetic coil 1 mounted on the base plate 13, and a solar battery module. A control circuit is coupled to the solar battery module for controlling the power output from the solar battery module. Specifically, the control circuit may be a battery positive-negative polarity inverting switch or a battery positive-negative polarity inverting circuit. The solar battery module can supply power to the electromagnetic coil 1 under the control of the control circuit as described in more detail below.

A furcated component 2 having two arms is positioned around the electromagnetic coil 1, with the two arms of the furcated component 2 disposed at opposite sides of the electromagnetic coil 1, respectively. In the description below, the arms of the furcated component 2 are sometimes referred to as left and right arms in terms of its location with respect to the electromagnetic coil 1 for the sake of clarity. The arms of the furcated component 2 are movable with respect to the electromagnetic coil 1. In the present embodiment, the furcated component 2 is mounted to the base plate 13 through a pivot 7 such that each arm of the furcated component 2 is pivotable about the pivot 7. The pivot 7 is connected to the base plate 13. With this pivot movement, each arm of the furcated component 2 is movable toward or away from the electromagnetic coil 1. A permanent magnet 3 and a permanent magnet 31 are disposed on the two arms of the furcated member 2, respectively, and are positioned in correspondence with the electromagnetic coil 1.

A first driving cable 4 and a second driving cable 5 are attached to two ends of the furcated component 2, respectively. The first and second driving cables 4 and 5 respectively extend along opposite two side portions of the simulation dog tail 10 to a distal end of the simulation dog tail 10. A pulley 6 is mounted on the base plate 1 and disposed on the path of the first driving cable 4 between the furcated component 2 and the simulation tail 10. Cable holes 9 are formed through the side portions of the articulated members of the simulation tail 10, for allowing the first and second driving cables 4 and 5 to pass therethrough.

In operation, when the control circuit controls the battery module to supply power to the electromagnetic coil 1 through one set of polarities, e.g., by sliding the switch to that one set of polarities, such that the magnetic pole of the electromagnetic coil 1 is the same as the magnetic pole of the permanent magnet 31 on one arm (e.g., the arm on the left side shown in FIG. 1) of the furcated component 2, the permanent magnet 31 on the left arm of the furcated component 2 and the electromagnetic coil 1 repulse each other based on the principle that same poles repulse. As a result, the left arm of the furcated component 2 is pivoted in a clockwise direction and away from the electromagnetic coil 1.

At this time, the pole of the electromagnetic coil 1 is opposite to the magnetic pole of the permanent magnet 3 on the other arm (e.g., the arm on the right side shown in FIG. 1) of the furcated component 2 and, therefore, the permanent magnet 31 on the right arm of the furcated component 2 and the electromagnetic coil 1 attract each other based on the principle that opposite poles attract. As a result, the right arm of the furcated component 2 is pivoted in a clockwise direction and toward the electromagnetic coil 1. The combined result of the clockwise pivot movements of the two arms of the furcated component 2 is that the furcated component 2 drives the first driving cable 4 to move in the clockwise direction such that the first driving cable 4 drives the simulation dog tail 10 to swing leftward.

On the other hand, when the control circuit controls the battery module to supply power to the electromagnetic coil 1 through the other set of polarities, e.g., by sliding the switch to the other set of polarities, the magnetic poles of the electromagnetic coil 1 are changed or reversed, such that the electromagnetic coil 1 attracts the permanent magnet 31 on the left arm of the furcated component 2 while repulsing the permanent magnet 3 on the right arm of the furcated component 2. As a result, the left arm of the furcated component 2 is pivoted in a counterclockwise direction and toward the electromagnetic coil 1, and the right arm of the furcated component 2 is pivoted in a counterclockwise direction and away from the electromagnetic coil 1. The combined result of the counterclockwise pivot movements of the two arms of the furcated component 2 is that the furcated component 2 drives the second driving cable 5 to move in a counterclockwise direction such that the second driving cable 5 drives the simulation tail to swing rightward.

It will be appreciated that the present swinging installment is more energy-saving because that, when operating, one arm of the furcated component 2 is under the attracting force while the other arm is under the repulsing force.

The pulley 6 is used to guide the first driving cable 4 as well as reduce friction between the first driving cable 4 and various parts of the swinging installment thus protecting the driving cable. It will be appreciated that another pulley can also be used with the second driving cable 5 for the same consideration. It will also be appreciated that the pulley can be omitted or another guiding mechanism other than the pulley is used. The cable holes formed in each of the articulated members of the simulation tail can also guide and protect the driving cables.

While the arms of the furcated component are illustrated as being pivotable about a pivot in the first embodiment, it is noted that the other form of movement of the arms can also be employed as long as the moving arms can drive the driving cables and hence the articulated members to move. It is also noted that it is not necessarily to use a furcated component as described in the first embodiment. Rather, any means that can be used to drive the driving cables and hence the articulated members to move is possible.

Second Embodiment

Figure 3:
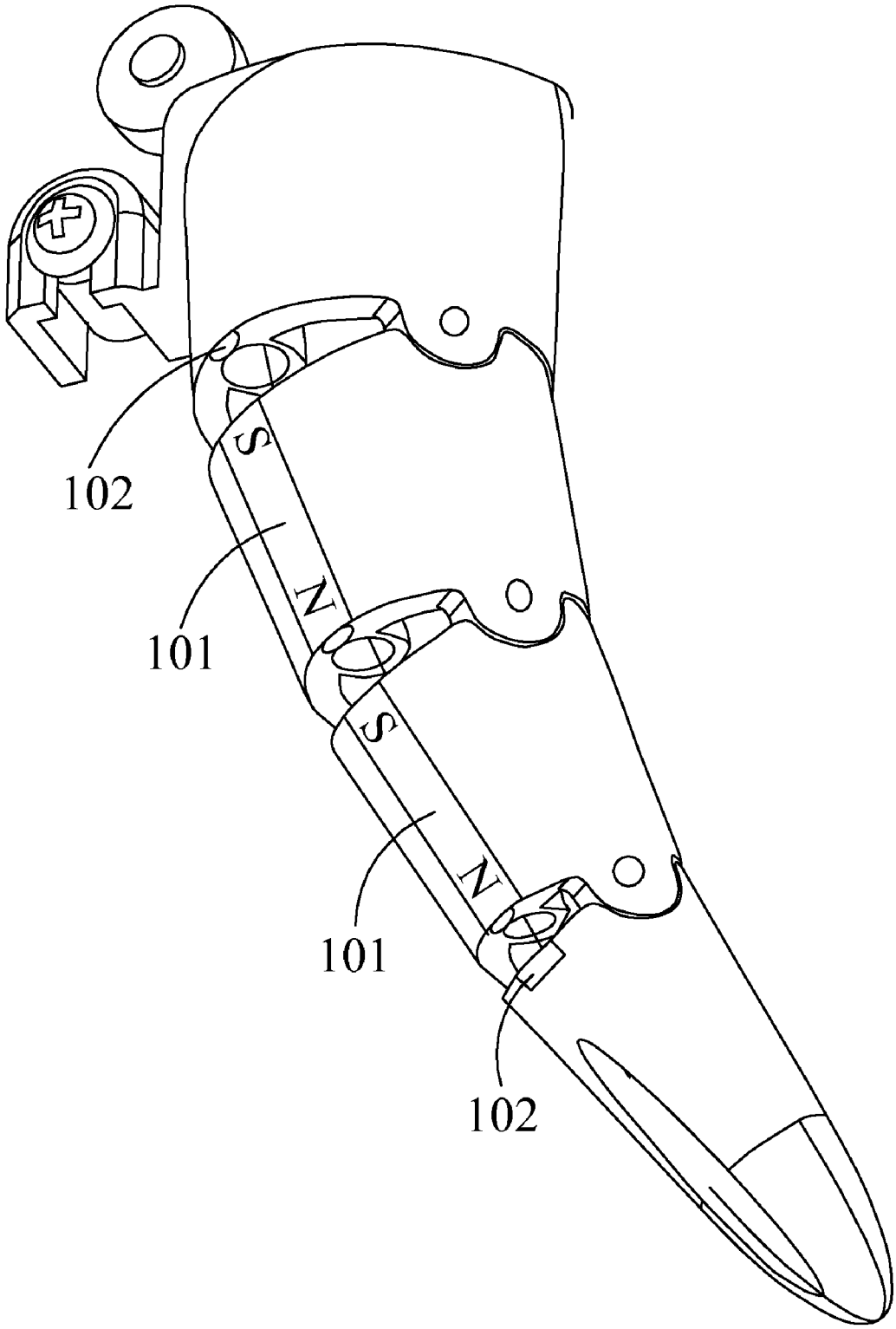
FIG. 3 illustrates a second embodiment of the simulation tail swinging installment in which the simulation tail is swinging rightward.
Figure 4:
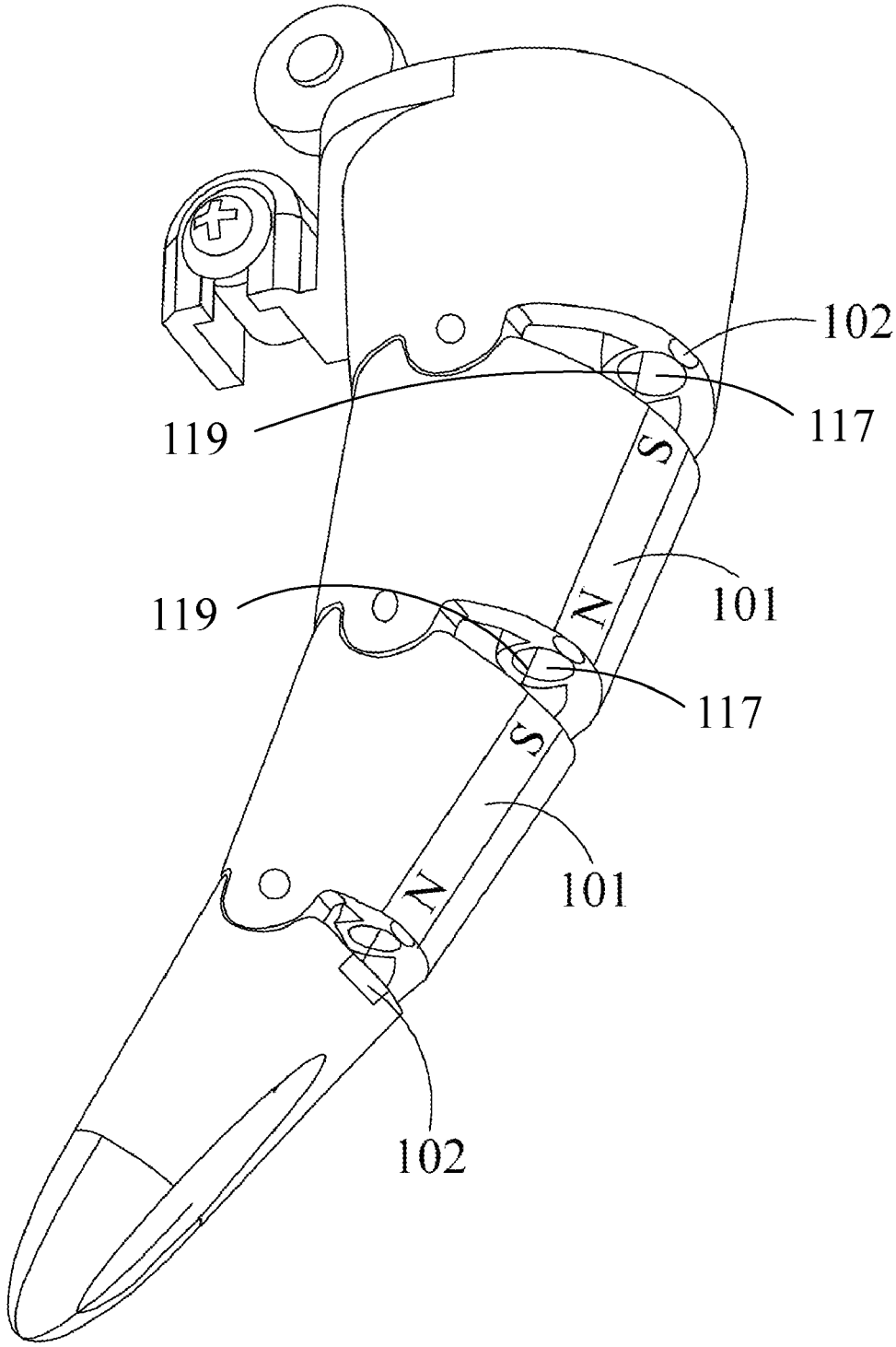
FIG. 4 illustrates the second embodiment of the simulation tail swinging installment in which the simulation tail is swinging leftward.

Referring to FIGS. 3, 4 and 5, a simulation tail swinging installment or apparatus in accordance with a second embodiment is illustrated for swinging a simulation dog tail. As shown, the simulation dog tail includes a plurality of articulated members which provide the free swinging activity of the simulation tail through relative movements between the articulated members. The simulation dog tail is illustrated as having four articulated members. It should be understood, however, that the number of the articulated members of the simulation dog tail can be varied based on actual requirements or designs. While the simulation tail swinging installment is described herein in conjunction with the simulation dog tail, it is noted that the simulation tail swinging installment described herein can also be used with other animal's tail such as a cat tail.

The simulation tail swinging installment of the second embodiment includes a plurality of electromagnetic coils 101 and a solar battery module 127 for supplying power to the electromagnetic coils 101. The electromagnetic coils 101 are disposed on opposite sides of the simulation tail 10. In the present embodiment, each side of each articulated member of the simulation tail 10 is equipped with one electromagnetic coil 10. A control circuit 129 is connected to the solar battery module 127 for controlling the power output from the solar battery module 127. Specifically, the control circuit 129 may be a battery positive-negative polarity inverting switch or a battery positive-negative polarity inverting circuit. The solar battery module 127 can supply power to the electromagnetic coils 101 under the control of the control circuit 129 as described in more detail below.

An iron member 102 is disposed at each joint of the articulated members. In the present embodiment, the electromagnetic coils 101 and the iron members 102 are arranged alternately along the simulation tail 10. The articulated members also form cable holes 117 therethrough. The battery module includes wires 119 extending though the cable holes 117 to supply power to the electromagnetic coils 101.

In operation, when the control circuit 129 controls the battery module 127 to supply power through one set of polarities, e.g., by sliding the switch to that one set of polarities, the power is supplied to the electromagnetic coils 101 on one side (e.g., the right side shown in FIG. 3) of the simulation tail 10 to energize the right side electromagnetic coils 101. Due to attraction between the right side electromagnetic coils 101 and the iron members 102 at the joints of the articulated members of the simulation tail 10, the articulated members are driven to swing rightward thus providing a rightward swing activity of the simulation tail 10. At this time, power is not supplied to the electromagnetic coils 101 on the opposite side (e.g., the left side shown in FIG. 3) of the simulation tail 10.

On the other hand, when the control circuit 129 controls the battery module 127 to supply power through the other set of polarities, e.g., by sliding the switch to the other set of polarities, the power is supplied to the electromagnetic coils 101 on the opposite side (e.g., the left side shown in FIG. 4) of the simulation tail 10 to energize the left side electromagnetic coils 101. Due to attraction between the left side electromagnetic coils 101 and the iron members 102 at the joints of the articulated members of the simulation tail 10, the articulated members are driven to swing leftward thus causing an overall leftward swing activity of the simulation tail 10. At this time, power is not supplied to the right side electromagnetic coils 101. Therefore, the simulation tail 10 can swing to the side on which the electromagnetic coils 101 are energized thus providing rightward or leftward swing of the simulation tail 10.

Thus, it can be seen that, under the control of the control circuit 129, the battery module 127 selectively supplies power to only the electromagnetic coils at one of the opposite sides of the articulated members at a time and supplies power to only the electromagnetic coils at the other side of the articulated member at another time, thus causing the swinging activity of the simulation tail in the selected directions.

While the positive-negative polarity inverting switch is illustrated in a form of simple switch in the above described embodiments, other forms of switch, such as a circuit board having a circuit for controlling the inverting of the positive-negative polarities, can be employed in alternative embodiments without departing the spirit and scope of the present invention.

In addition, it should be understood that the leftward and rightward swinging of the simulation tail is for the purposes of illustration only and should not be regarded as limiting. Rather, the swinging installment described herein can be readily modified to achieve swinging in other directions, such as, upward or downward swing if the swinging in those directions is desired.

In summary, in broad terms, there is provided a simulation tail swinging installment which includes a magnetically interactable module and an electromagnetic module. The electromagnetic module is disposed with respect to the magnetically interactable module. At least one of the magnetically interactable module and the electromagnetic module is connected with the simulation tail for driving the simulation tail to swing when the magnetically interactable module magnetically interacts with the electromagnetic module. A battery module is configured to supply power to the electromagnetic module to cause interaction between the magnetically interactable module and the electromagnetic module. Wherein the battery module is configured to selectively supply power to the electromagnetic module in a first mode in which the interaction between the magnetically interactable module and the electromagnetic module causes the simulation tail to swing in a first direction, and a second power mode in which the interaction between the magnetically interactable module and the electromagnetic module causes the simulation tail to swing in a second opposite direction.

The magnetically interactable module can include a first permanent magnet and a second permanent magnet, and the electromagnetic module can include one electromagnetic coil, as described in the first embodiment. The first mode can be such that the battery module supplies the power through one set of polarities, and the second power mode can be such that the battery module supplies the power through the other set of polarities. Magnetic poles of the electromagnetic coil when energized in the first power mode are opposite to magnetic poles of the electromagnetic coil when energized in the second power mode.

Alternatively, the magnetically interactable module can include a plurality of magnetic conductive members such as iron members disposed at joints of articulated members of the simulation tail, the electromagnetic module can include a plurality of electromagnetic coils disposed on opposite sides of the articulated members, and the magnetic conductive members and the electromagnetic coils are arranged alternately along the simulation tail, as described in the second embodiment. Likewise, the first mode can be such that the battery module supplies the power through one set of polarities, and the second power mode can be such that the battery module supplies the power through the other set of polarities. Only the electromagnetic coils at one side of the simulation tail are energized in the first power mode, and only the electromagnetic coils at the other side of the simulation tail are energized in the second power mode.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A simulation tail swinging installment comprising:

a base plate;

an electromagnetic coil disposed on the base plate;

a battery module configured for supplying power to the electromagnetic coil;

a control circuit coupled to the battery module;

a furcated component having two arms disposed with respect to the electromagnetic coil, with the two arms located on opposite sides of the electromagnetic coil, respectively, each of the arms comprising a permanent magnet positioned in correspondence with the electromagnetic coil, the furcated component being pivotably mounted to the base plate;

a first driving cable and a second driving cable attached to the two arms, respectively, the first driving cable and the second driving cable extending through and along two side portions of a simulation tail and secured to a distal end of the simulation tail.

2. The simulation tail swinging installment of claim 1 further comprising a pulley disposed along a path of the first driving cable for guiding the first driving cable.

3. The simulation tail swinging installment of claim 1, wherein the simulation tail comprises a plurality of articulated members, each of the articulated members forming cable holes for allowing the first and second driving cables to extend therethrough.

4. The simulation tail swinging installment of claim 1, wherein the battery module is a solar battery module.

5. The simulation tail swinging installment of claim 1, wherein the control circuit is one of a battery positive-negative polarity inverting switch and a battery positive-negative polarity inverting circuit.

6. A simulation tail swinging installment for swinging a simulation tail comprising a plurality of articulated members, the articulated members including two outermost members and a plurality of intermediate articulated members, the swinging installment comprising:

a battery module;

two electromagnetic coils disposed at opposite sides of each of the intermediate articulated members;

iron members disposed at joints of the intermediate articulated members;

a control circuit configured to control the battery module to selectively supply power to electromagnetic coils at only one of the opposite sides of each of the intermediate articulated members at a time to cause attraction between the electromagnetic coils and the iron members, thus causing a swinging activity of the simulation tail.

7. The simulation tail swinging installment of claim 6, wherein the battery module is a solar battery module.

8. The simulation tail swinging installment of claim 6, wherein the iron members and the electronic coils are arranged alternately along the simulation tail.

9. The simulation tail swinging installment of the claim 6, wherein holes are formed through the intermediate articulated members on which the electromagnetic coils are disposed, and the battery module comprises wires extending through the holes to supply the power to the electromagnetic coils.

10. A simulation tail swinging installment comprising:

a magnetically interactable module;

an electromagnetic module disposed with respect to the magnetically interactable module;

at least one of the magnetically interactable module and the electromagnetic module being connected with a simulation tail for driving the simulation tail to swing when the magnetically interactable module magnetically interacts with the electromagnetic module;

a battery module configured to supply power to the electromagnetic module to cause interaction between the magnetically interactable module and the electromagnetic module, wherein the battery module is configured to selectively supply power to the electromagnetic module in a first mode in which the interaction between the magnetically interactable module and the electromagnetic module causes the simulation tail to swing in a first direction, and a second power mode in which the interaction between the magnetically interactable module and the electromagnetic module causes the simulation tail to swing in a second opposite direction, wherein the magnetically interactable module comprises a first permanent magnet and a second permanent magnet, the first permanent magnet is configured to drive the simulation tail through a first driving cable, and the second permanent magnet is configured to drive the simulation through a second driving cable.

11. The simulation tail swinging installment of claim 10, wherein the first and second permanent magnets are disposed on two movable arms, and the pivotable arms are disposed on opposite sides of the electromagnetic module and movable with respect to the electromagnetic module.

12. The simulation tail swinging installment of claim 10, wherein the first driving cable extends through and along one side portion of the simulation tail and is secured to a distal end of the simulation tail, and the second driving cable extends through and along an opposite side portion of the simulation tail and is secured to the distal end of the simulation tail.

13. The simulation tail swinging installment of claim 12, wherein each of the articulated members has cable holes for allowing the first and second driving cables to pass therethrough.

14. The simulation tail swinging installment of claim 10, wherein the electromagnetic module comprises an electromagnetic coil configured to repulse one of the first and second permanent magnets while attracting the other of the first and second permanent magnets when the electromagnetic coil is energized.

15. The simulation tail swinging installment of claim 10, wherein the simulation tail comprises a plurality of articulated members, the magnetically interactable module comprises a plurality of magnetic conductive members disposed at joints of the articulated members, and the electromagnetic module comprises a plurality of electromagnetic coils disposed on opposite sides of the articulated members.

16. The simulation tail swinging installment of claim 15, wherein the magnetic conductive members and the electromagnetic coils are arranged alternately along the simulation tail.

17. The simulation tail swinging installment of claim 15, wherein only the electromagnetic coils at one side of the simulation tail are energized in the first power mode, and only the electromagnetic coils at the other side of the simulation tail are energized in the second power mode.

18. The simulation tail swinging installment of claim 15, wherein each articulated member with the electromagnetic coil disposed thereon has a hole defined therethrough, and the battery module comprises a wire extending through the hole to supply the power to the corresponding electromagnetic coil.

19. The simulation tail swinging installment of claim 10 further comprising a control circuit coupled to the battery module for controlling the first and second power modes.

* * * * *